US010281117B2

(12) United States Patent
Read et al.

(10) Patent No.: US 10,281,117 B2
(45) Date of Patent: May 7, 2019

(54) VARIABLE HEIGHT ILLUMINATION ASSEMBLY

(71) Applicant: Lumenpulse Lighting Inc., Montreal, Quebec (CA)

(72) Inventors: Daniel L. Read, Timperley (GB); Joseph G. S. De Nardo, Buxton (GB); Sebastien Bire, Montreal (CA)

(73) Assignee: Lumenpulse Group Inc. (CA)

( * ) Notice: Subject to any disclaimer, the term of this patent is extended or adjusted under 35 U.S.C. 154(b) by 142 days.

(21) Appl. No.: 15/358,967

(22) Filed: Nov. 22, 2016

(65) Prior Publication Data

US 2018/0142867 A1 May 24, 2018

(51) Int. Cl.

| | |
|---|---|
| ***F21V 29/74*** | (2015.01) |
| ***F21V 17/00*** | (2006.01) |
| ***F21V 17/02*** | (2006.01) |
| ***F21V 17/16*** | (2006.01) |
| ***F21S 8/04*** | (2006.01) |
| ***F21V 7/04*** | (2006.01) |
| ***F21V 23/00*** | (2015.01) |
| ***F21V 29/77*** | (2015.01) |
| *F21V 7/00* | (2006.01) |
| *F21V 23/02* | (2006.01) |

(52) U.S. Cl.

CPC ..... *F21V 17/16* (2013.01); *F21S 8/04* (2013.01); *F21V 7/041* (2013.01); *F21V 17/002* (2013.01); *F21V 17/02* (2013.01); *F21V 17/162* (2013.01); *F21V 23/003* (2013.01); *F21V 29/74* (2015.01); *F21V 29/773* (2015.01); *F21V 7/0066* (2013.01); *F21V 23/023* (2013.01)

(58) Field of Classification Search

CPC ..... F21V 17/16; F21V 17/10; F21S 8/04

See application file for complete search history.

(56) References Cited

U.S. PATENT DOCUMENTS

| | | | | |
|---|---|---|---|---|
| 3,562,513 | A | 2/1971 | Jaffe | |
| 5,868,493 | A | 2/1999 | Winkelhake | |
| 6,588,922 | B1 | 7/2003 | DeCicco | |
| 8,545,063 | B2 * | 10/2013 | Dupuy | F21S 8/02 362/365 |
| 8,899,374 | B2 * | 12/2014 | Tanaka | H04R 1/026 181/150 |
| 9,803,838 | B1 * | 10/2017 | Wronski | F21S 8/02 |
| 2013/0003362 | A1 * | 1/2013 | Kang | F21S 8/043 362/185 |
| 2013/0258685 | A1 | 10/2013 | Clifton et al. | |
| 2015/0043210 | A1 | 2/2015 | Liu et al. | |
| 2015/0323162 | A1 * | 11/2015 | Xu | F21S 8/00 362/311.02 |
| 2017/0082265 | A1 * | 3/2017 | Xie | F21S 8/00 |
| 2017/0284643 | A1 * | 10/2017 | Coakley | F21V 21/14 |

OTHER PUBLICATIONS

International Search Report and Written Opinion from related PCT Application No. PCT/US2017/060850 dated Jan. 26, 2018.

* cited by examiner

*Primary Examiner* — William N Harris

(74) *Attorney, Agent, or Firm* — Burns & Levinson, LLP; Joseph M. Maraia

(57) ABSTRACT

A lighting fixture includes a light engine elastically coupled to a front ring module. The light engine includes a heat sink and at least one biasing member is coupled between the heat sink and the front ring module. The at least one biasing member is configured to urge the front ring module toward the heat sink. The biasing member could be a spring or an elastic band.

12 Claims, 10 Drawing Sheets

VARIABLE HEIGHT ILLUMINATION ASSEMBLY

FIELD OF THE INVENTION

The disclosure relates to a field-modifiable lighting system.

BACKGROUND OF THE INVENTION

In some installations it may be necessary to modify an already installed lighting fixture. Not many lighting fixtures or products, however, have field changeable optics, accessories or a system that allows for easy removal of these items without disassembling the product itself. The disassembly of known lighting systems, however, can involve removing the fixture from the ceiling, unscrewing components, adding components, and then reinstalling, etc., so such a process involves time and money and the risk of damage to the existing installation and/or product.

What is needed, therefore, is a system that allows for the adding or removing of components from an already installed lighting fixture without requiring excessive reconstruction and disassembly.

SUMMARY

According to one aspect of the disclosure, a lighting fixture includes a light engine; a front ring module; and a first structure comprising means for biasing the front ring module toward the light engine. The biasing means may be a spring or an elastic component in one implementation.

The first structure, in another implementation, may include a first bracket coupled to the light engine and to the biasing means.

In another aspect of the disclosure, a light engine comprises a heat sink; a front ring module; and at least one biasing member coupled between the heat sink and the front ring module, with the at least one biasing member configured to urge the front ring module toward the heat sink.

BRIEF DESCRIPTION OF THE DRAWINGS

Various aspects of at least one embodiment of the present invention are discussed below with reference to the accompanying Figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, however, not every component may be labeled in every drawing. The Figures are provided for the purposes of illustration and explanation and are not intended as a definition of the limits of the invention. In the Figures.

DETAILED DESCRIPTION

Figure 1A:
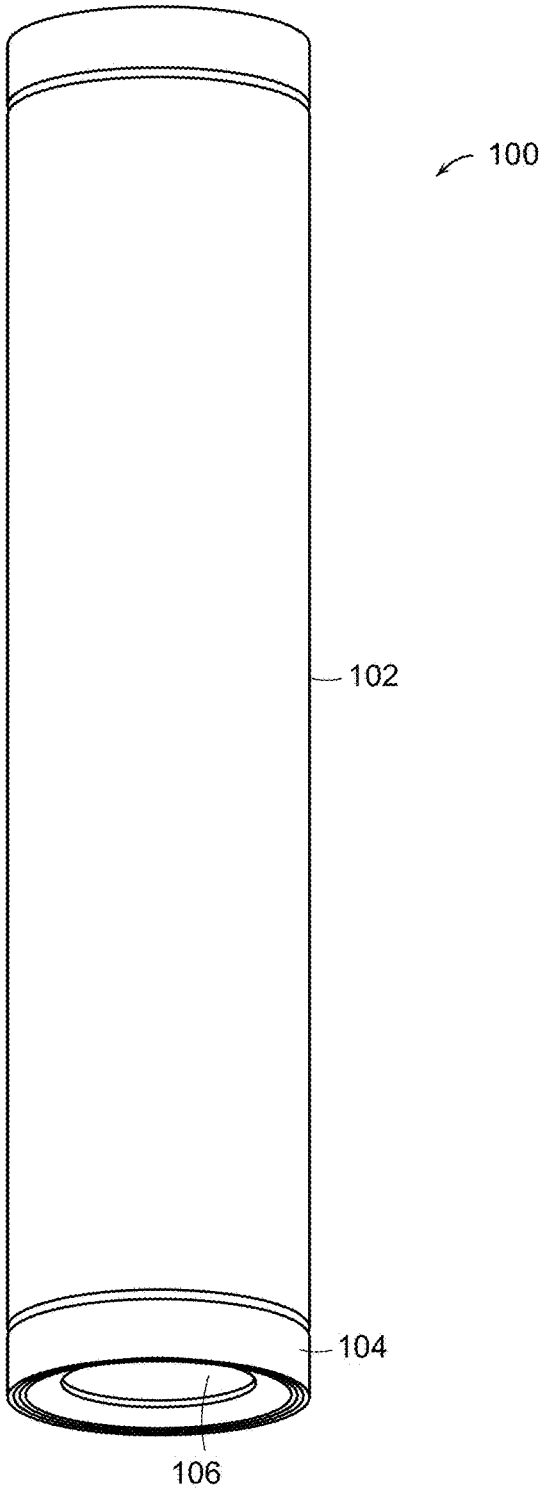
FIGS. 1A and 1B are representative of a lighting fixture in accordance with an aspect of the present disclosure.

In the following detailed description, numerous specific details are set forth in order to provide a thorough understanding of the aspects and embodiments of the present invention. It will be understood by those of ordinary skill in the art that these may be practiced without some of these specific details. In other instances, well-known methods, procedures, components and structures may not have been described in detail so as not to obscure the embodiments of the present invention.

It is to be understood that the details of construction and the arrangement of the components set forth in the following description or illustrated in the drawings are not limiting. There are other ways of being practiced or carried out. Also, it is to be understood that the phraseology and terminology employed herein are for the purpose of description only and also should not be regarded as limiting.

It is appreciated that certain features, which are, for clarity, described in the context of separate embodiments, may also be provided in combination in a single embodiment. Conversely, various features, which are, for brevity, described in the context of a single embodiment, may also be provided separately or in any suitable sub-combination.

Figure 1B:
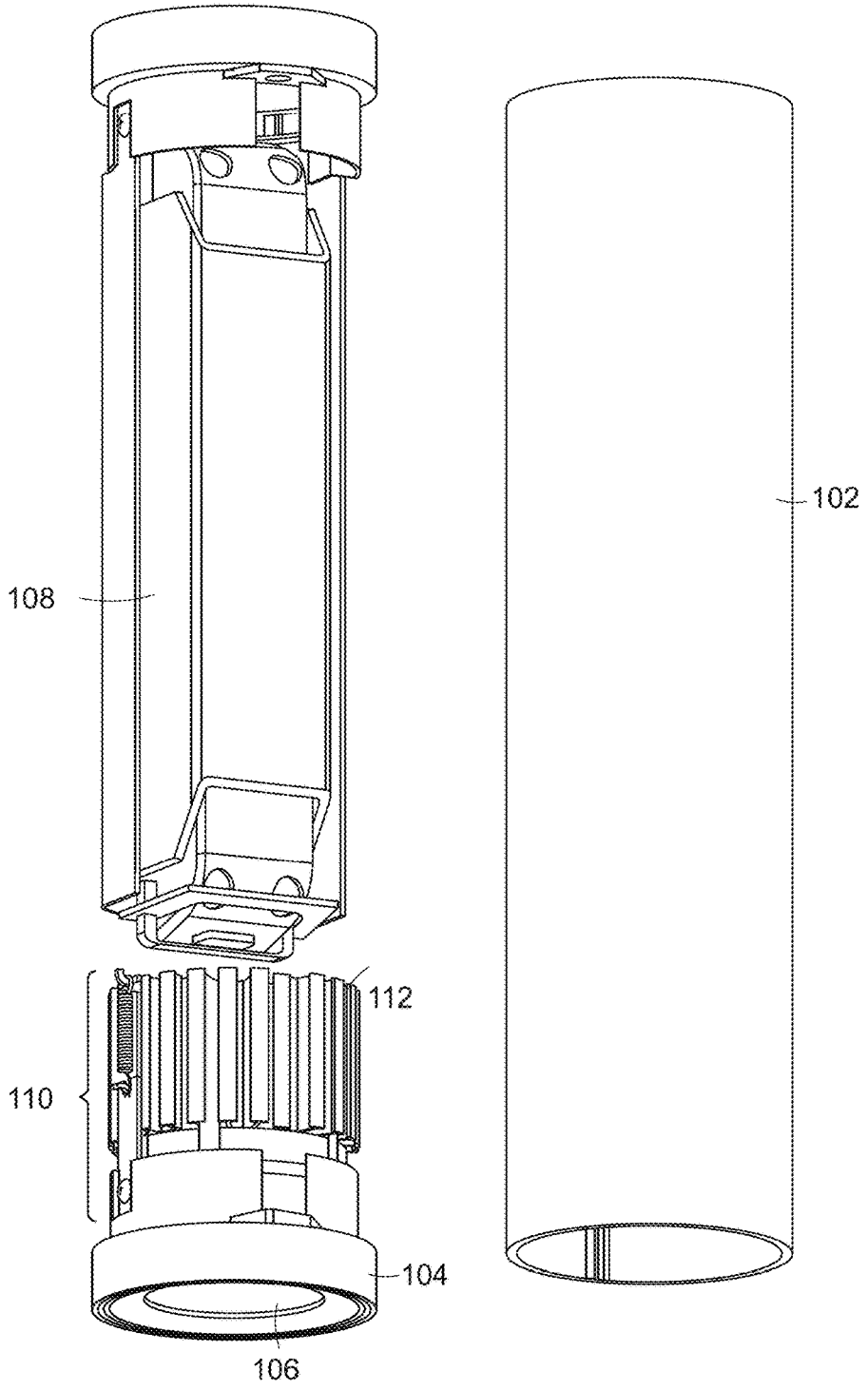

Referring now to FIGS. 1A and 1B, in one aspect of the present disclosure, a light fixture 100 includes a cylinder 102 with a front ring module 104 at a distal end. The front ring module 104 surrounds a reflector cone 106 from which the light is emitted.

Figure 2A:
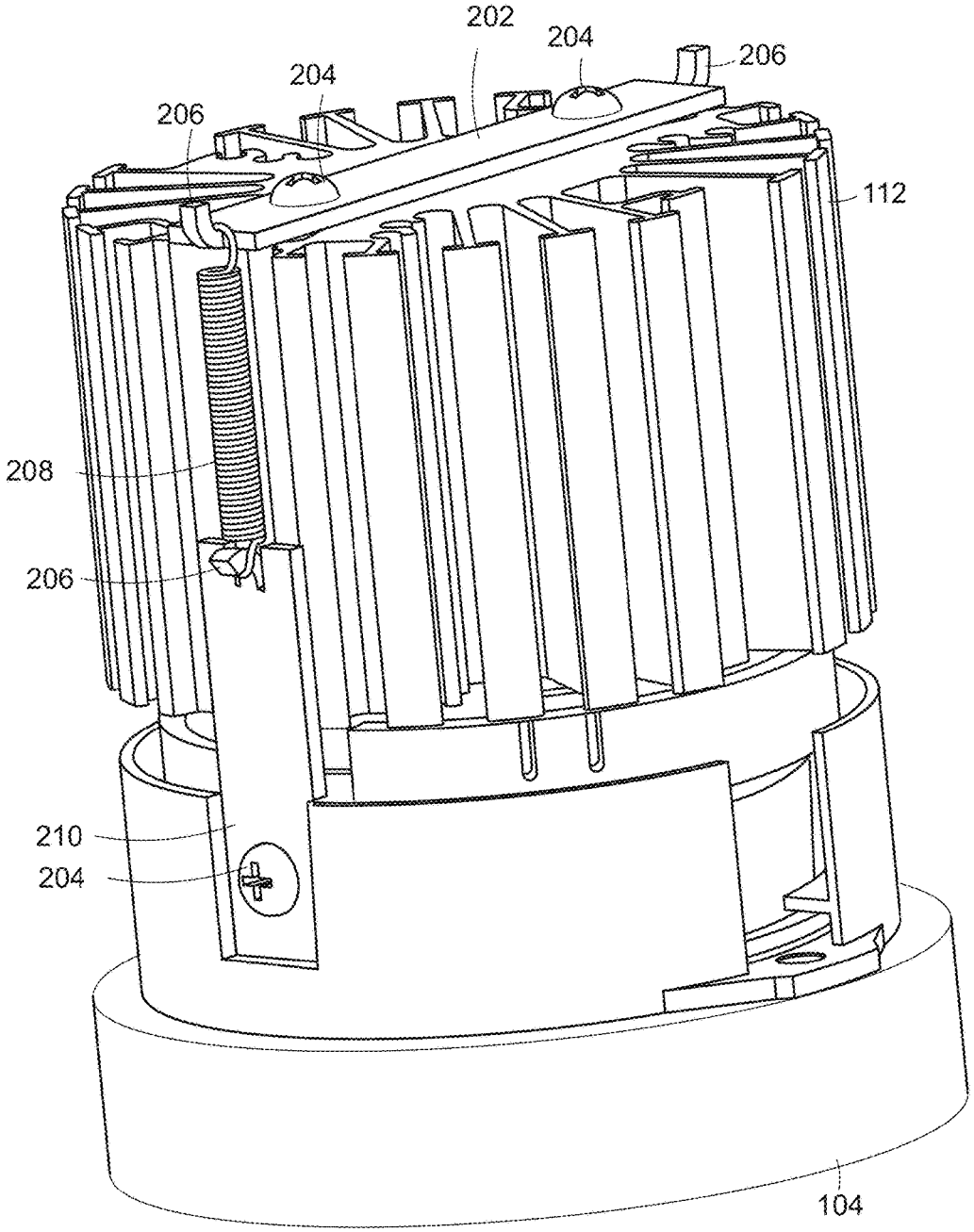
FIGS. 2A-2C are representative of an implementation of a lighting fixture in accordance with the present disclosure.
Figure 2B:
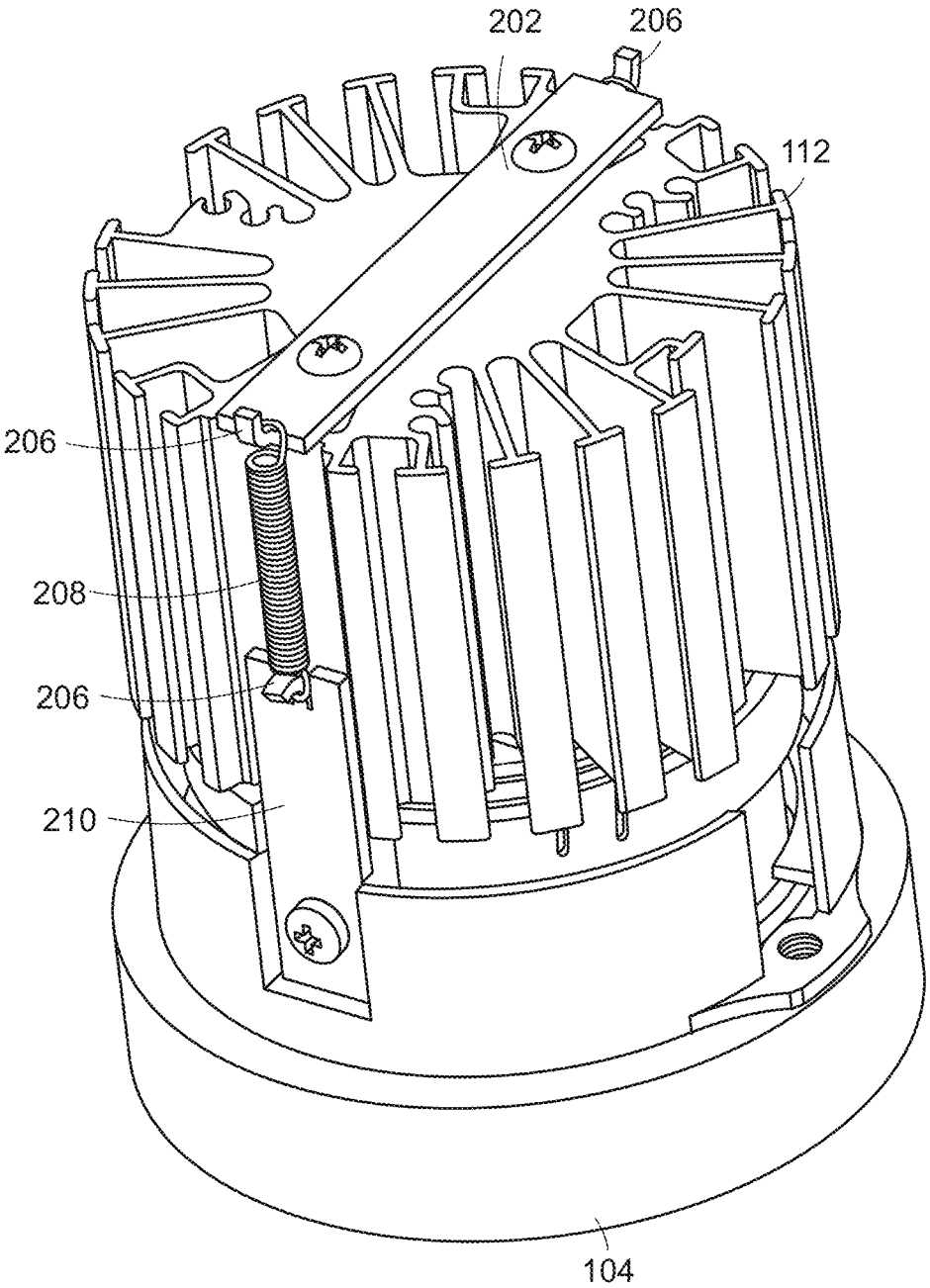
Figure 2C:
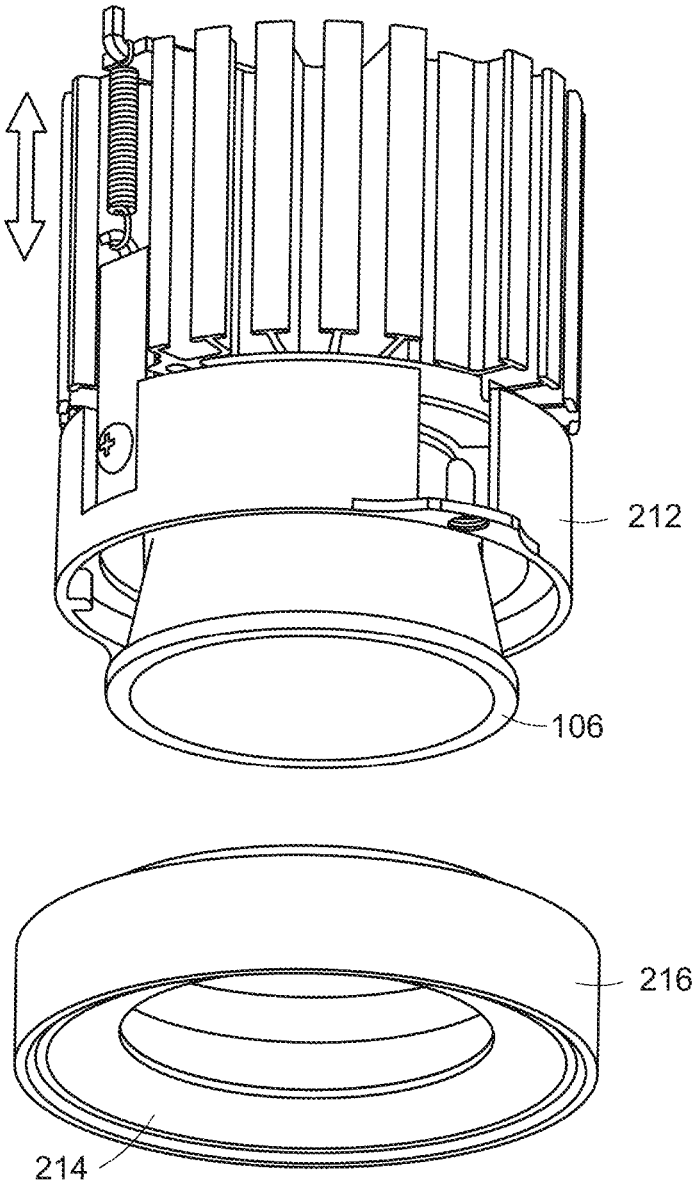

As shown in FIG. 2C, the front ring module 104 comprises a fixing ring 212, an accessory holder 214 and a front ring 216. In one implementation, the fixing ring 212 is coupled to the cylinder 102. The accessory holder 214 and the front ring 216 may be permanently coupled to one another and then coupled to the fixing ring 212 by, for example, a twist-and-lock mechanism although other mechanisms could be used.

The light fixture includes a power supply 108 coupled to a light engine 110. The light engine 110 includes a heat sink, a light source (not shown) and the reflector cone 106. The front ring module 104 is a separate component from the light engine 110.

A top bracket 202 is coupled to the heat sink 112 and generally placed across the circumference of the heat sink 112 as shown in FIGS. 2A and 2B. The top bracket 202 may be, in one implementation, attached to the heat sink 112 by one or more screws 204 or similar fastening mechanisms as known to those of skill in the art. Alternatively, the top bracket 202 may be integrated with the heat sink 112 and not a separately attachable part. The top bracket 202 includes a hook 206 provided at each end. One of ordinary skill in the art will understand that other mechanisms, aside from the hook 206, could be used to couple the biasing member to the top bracket. It could be, for example, an opening in the top bracket through which the end loop of the spring is coupled or, otherwise, attached as well as bar disposed in an opening around which a looped elastic could be placed.

First and second biasing members 208 are attached, respectively, to the ends of the top bracket 202. In one implementation, a spring is implemented as the biasing member and a first loop at a first end of each spring 208 is coupled to the respective hook 206 on the top bracket 202.

A second end of each spring 208 is coupled to a hook 206 provided on a free end of a respective side bracket 210, as shown. The side brackets 210 are symmetrically provided around the front ring module 104 and each is coupled to the front ring module 104 by, for example, a screw 204 or similar fastener, or the side bracket 210 could be an integral part of the front ring module 104. As shown in FIGS. 2A and 2B, the spring 208 and its respective side bracket 210 are collinear with one another.

While a pair of opposed biasing members, e.g., springs, are shown, any number of two or more biasing members and corresponding side brackets could be provided around the periphery of the heat sink with a correspondingly configured top bracket as would be understood by one of ordinary skill in the art. Further, the biasing members could be symmetrically or asymmetrically arranged around the heatsink which itself might not necessarily be circular.

By operation of the biasing member 208, the front ring module 104 is biased toward the heat sink 112. Thus, when the cylinder 102 is provided, as shown in FIG. 1A, the front ring module 104 will pull the assembly together. When necessary, the front ring module 104 can be pulled away from the cylinder 102, at least to the extent allowable by the size of the biasing member 208, in order for changes and/or repairs to the components within to be performed. Advantageously, with this structure, the changes can be made without removing the light fixture from its installed position.

While a spring 208 has been described in one implementation of the biasing member, one of ordinary skill in the art will understand that other biasing forms could be used instead. These include, but are not limited to, an elastic band, e.g., a rubber band.

Figure 3:
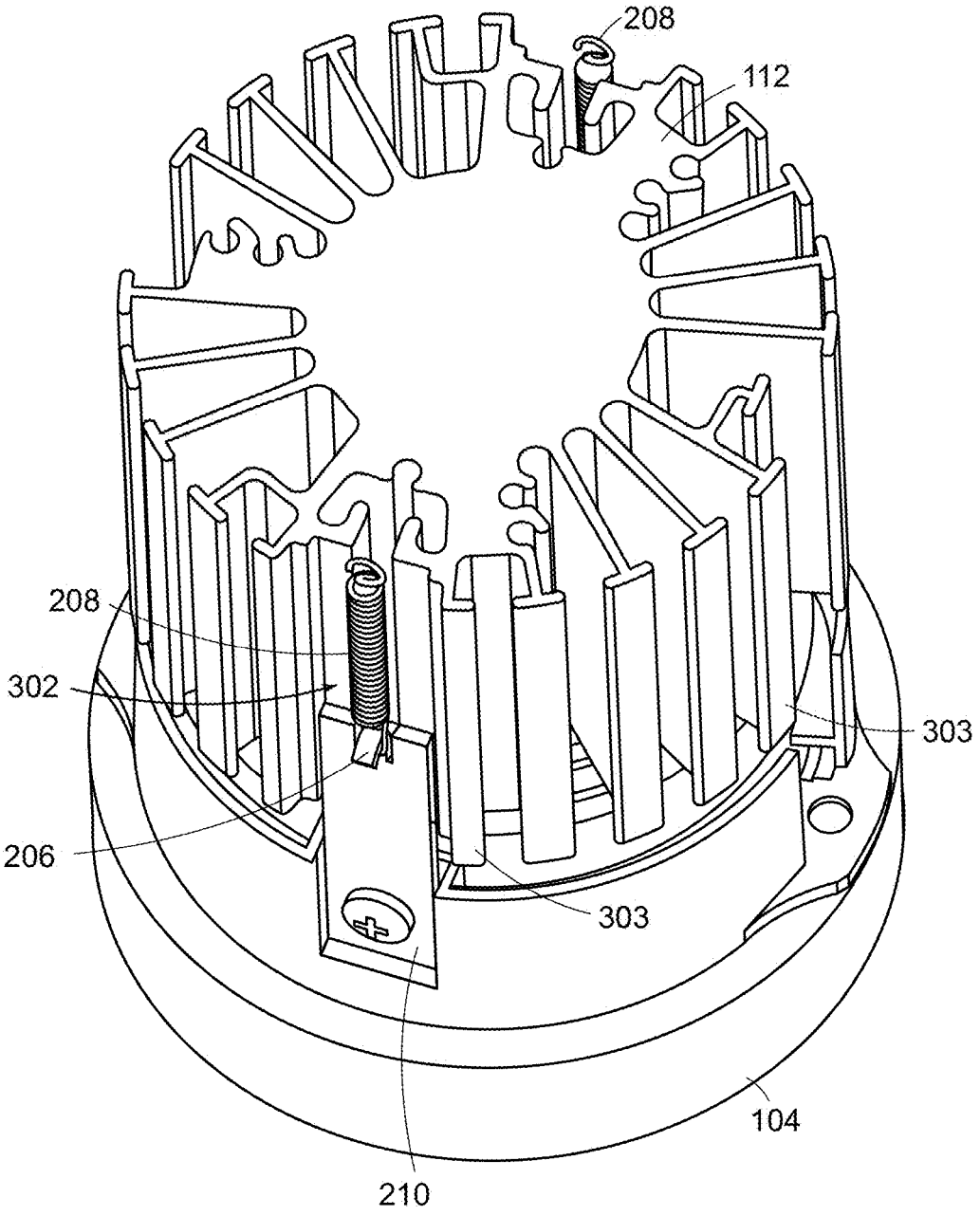
FIG. 3 is partial view of the implementation of FIGS. 2A and 2B.

The heat sink 112 is designed such that a guide slot 302 is provided between adjacent fins along which the side brackets 210 can slide, as shown in FIG. 3. The guide slot 302 can, alternatively, be a groove defined in the heat sink 112, for example, between adjacent fins, or could be a surface along which the side bracket 210 can slide. Of course, one of ordinary skill in the art will understand that there are other equivalent approaches that could be implemented.

Figure 4A:
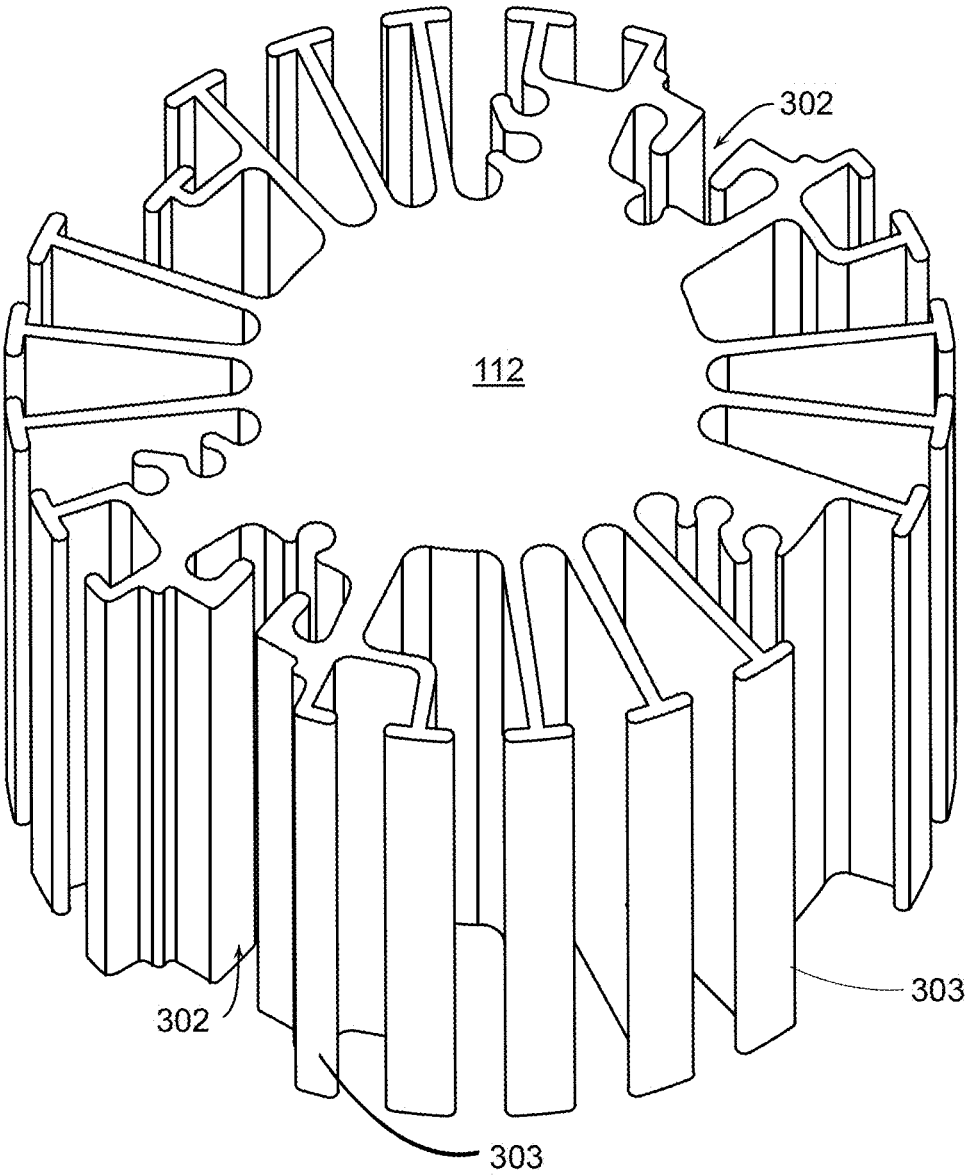
FIGS. 4A and 4B are representative of a heat sink portion of a lighting fixture in accordance with an implementation of the present disclosure.
Figure 4B:
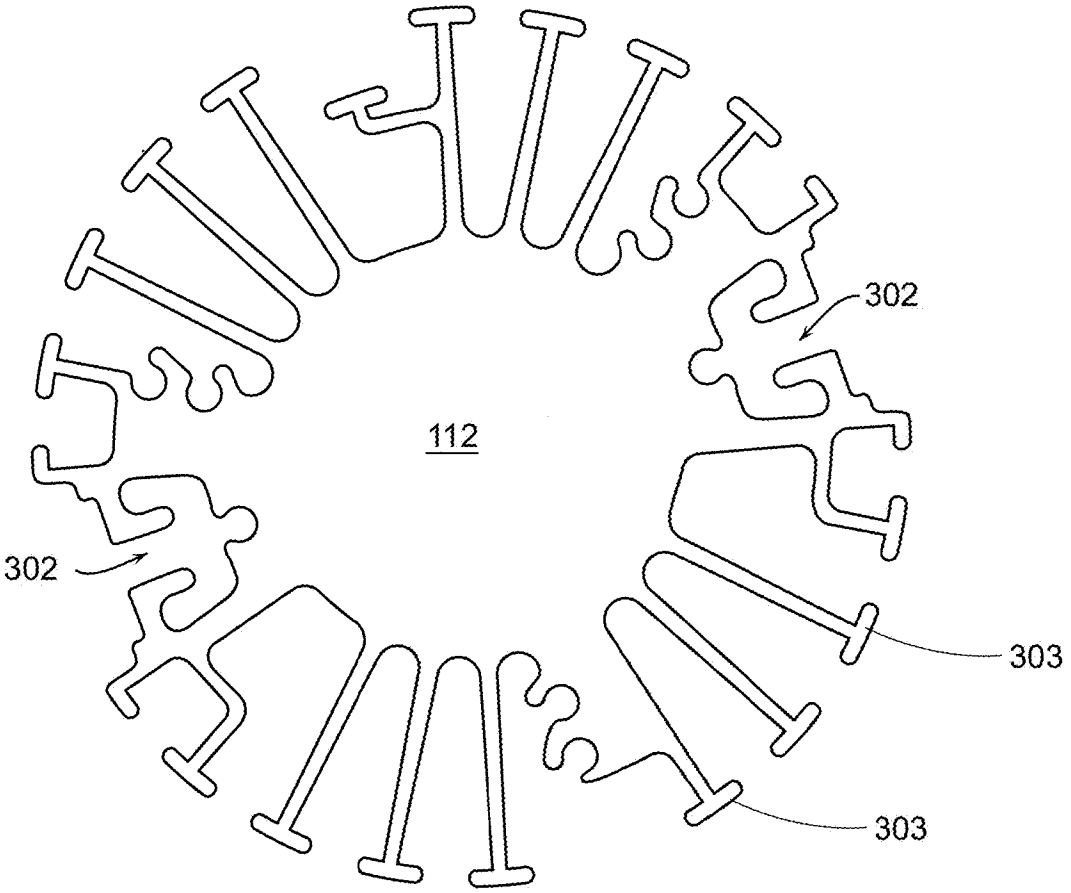

The guide slot 302 may be provided such that the side brackets 210 slide along a surface as urged by the corresponding biasing member 208, as shown in FIGS. 4A and 4B. Of course, one of ordinary skill understands that the size of the top bracket 202 would be provided such that the side bracket 210 is appropriately positioned in the guide slot 302.

Figure 5:
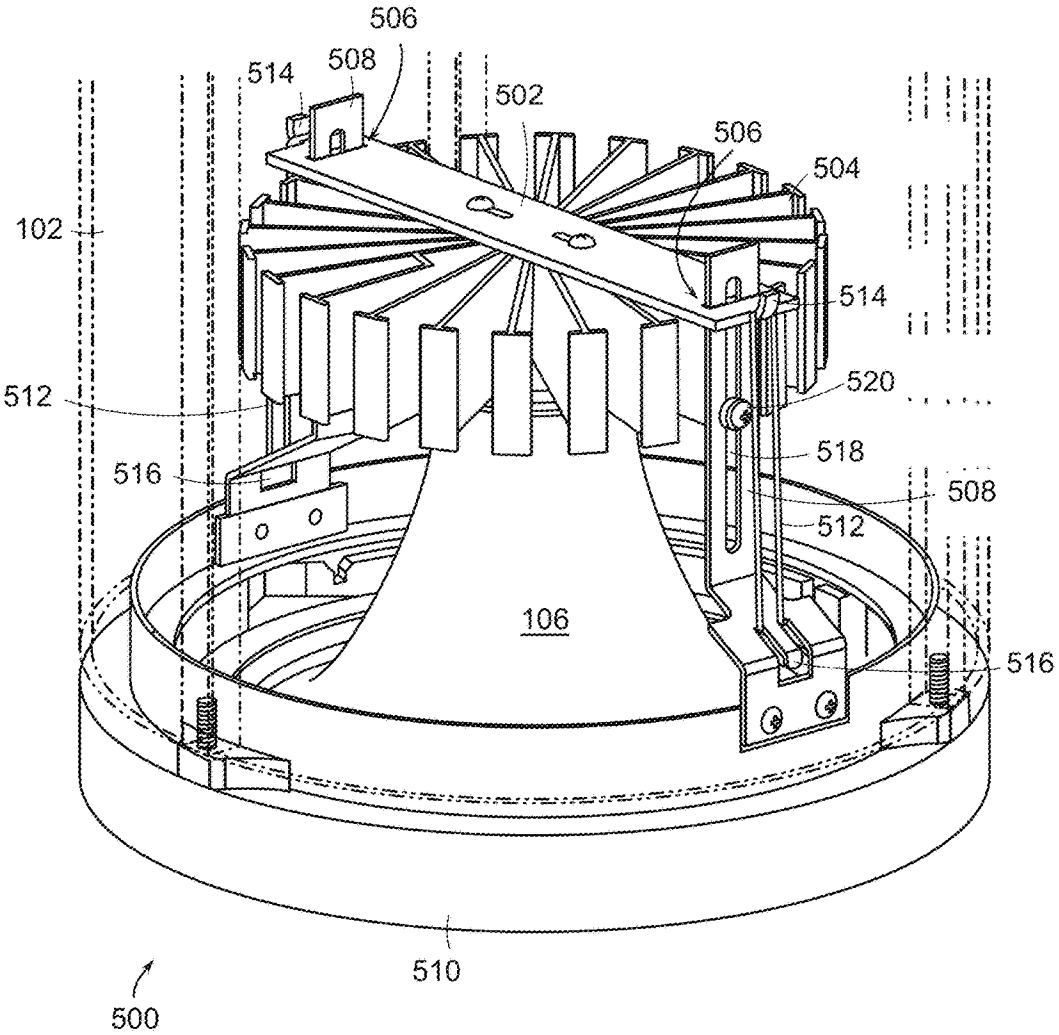
FIG. 5 is an implementation of a lighting fixture in accordance with the present disclosure.

In an alternate implementation of an aspect of the present disclosure, as shown in FIG. 5, a lighting fixture 500 includes a top bracket 502 coupled to a heat sink 504, similar to the implementation described above. The top bracket 502 includes two slots 506, with each slot 506 slidably receiving a respective side bracket 508. One end of the side bracket 508 freely slides in its respective slot 506 while the other end of the side bracket 508 is coupled to a front ring module 510. The side bracket 508 may be screwed to the front ring module 510, integrated into the front ring module 510 or mechanically coupled in any one of a number of ways as would be understood by one of ordinary skill in the art.

A biasing member 512, in the form of a looped elastic band in one implementation, couples a hook 514 provided on the top bracket 502 to a tab 516 on the respective side bracket 508 to urge the front ring module 510 and top bracket 502 toward one another. While a looped elastic band 512 is shown, a single strand of elastic material may be used, e.g., tied off at each end or a spring may be used instead. Still further, other implementations could be provided by one of skill in the art.

A longitudinal slot 518 is provided in each side bracket. Further, and in order to facilitate the linear movement of the side bracket through the top bracket slot 506, a guide post 520, in the form of a removable set screw, is provided through the side bracket longitudinal slot 518 and set into the heat sink 504. While a removable set screw is shown in this implementation, in an alternate implementation, a post 520 may be formed on the heat sink 504 to coincide with, and protrude through, the side bracket longitudinal slot 518, in order to provide linearity of movement.

Figure 6:
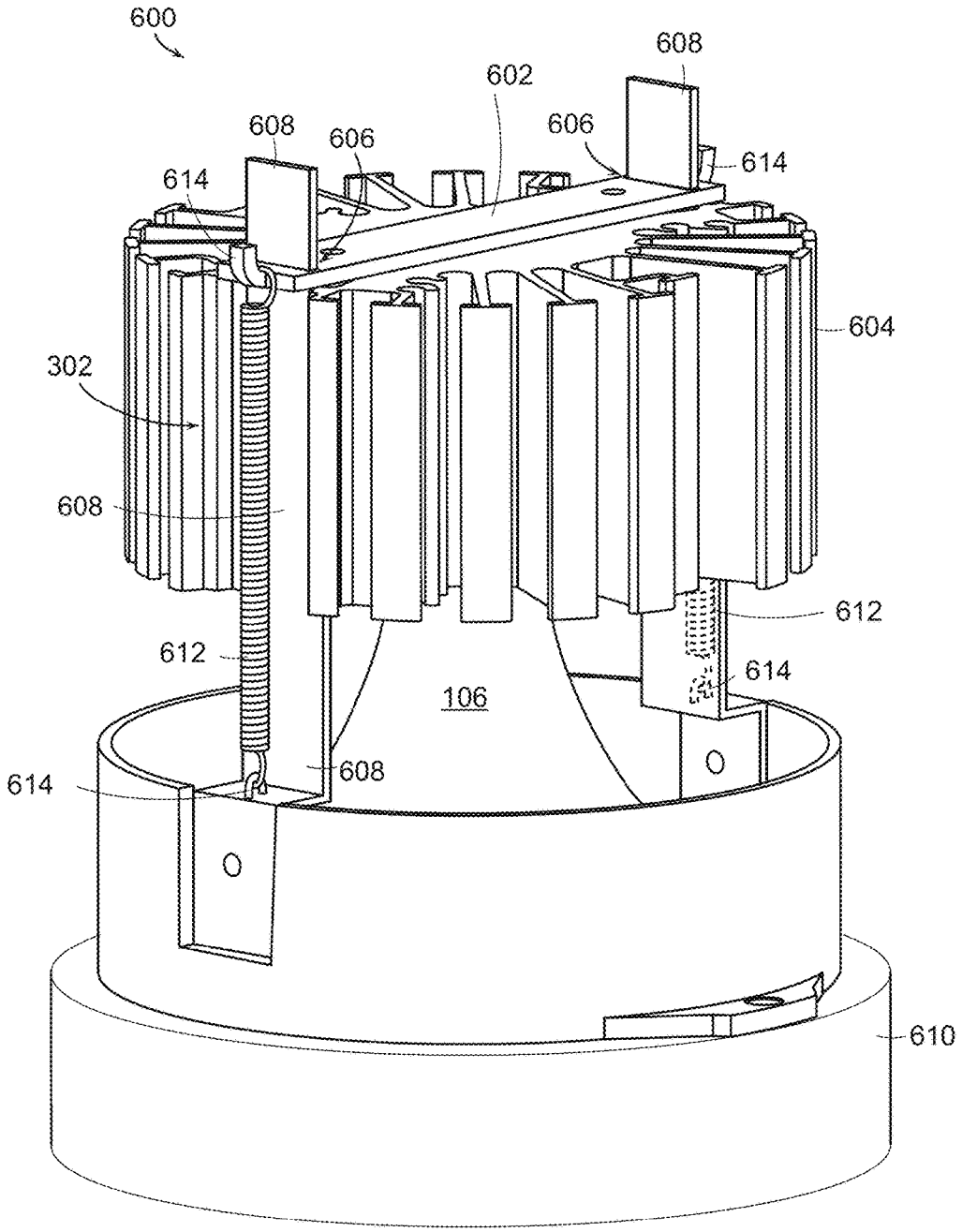
FIG. 6 is an implementation of a lighting fixture in accordance with the present disclosure.

Referring now to FIG. 6, an alternate implementation combines elements of the foregoing implementations. Thus, a lighting fixture 600 includes a top bracket 602 coupled to a heat sink 604, similar to the implementation described above. The top bracket 602 includes two slots 606, with each slot 606 slidably receiving a respective side bracket 608. One end of the side bracket 608 freely slides in its respective slot 606 while the other end of the side bracket 608 is coupled to a front ring module 610. The side bracket 608 may be screwed to the front ring module 610 or mechanically coupled in any one of a number of ways as would be understood by one of ordinary skill in the art.

A biasing member 612, for example, a spring, couples a hook 614 provided on the top bracket 602 to a loop or hook 614 on the respective side bracket 608 to urge the front ring module 610 and the top bracket 602 toward one another. While a spring 612 is shown, an elastic band, or other mechanism as referenced above, may be used instead. Still further, other implementations could be provided by one of skill in the art.

To maintain the linear movement of the side bracket 608 with respect to the heat sink 604, the side bracket 608 slides along, or within, a groove or guide slot in the heat sink 604, as has already been described above.

In each of the implementations shown in FIGS. 5 and 6, the biasing member, in the form of an elastic band or spring moves substantially parallel, i.e., ±10% to a linear direction of motion of the respective side bracket. Alternatively, although not as effective, the elastic band or spring is configured to move within ±30% parallel of the respective side bracket.

In addition, in another implementation, where the side bracket extends through the top bracket, each side bracket is provided with a portion, for example, a bend, in order to prevent the front ring module from being pulled so far that the side bracket is pulled free from the top bracket.

Further, it should be noted that the use of "top" and "side" are merely labels used to denote relative locations in order to aid in the explanation of the implementations of the present disclosure. These labels are not meant to otherwise limit the attached claims.

It will be understood by those reasonably skilled in the art that the techniques disclosed herein may be similarly applied to the design, manufacture and fabrication of other illuminating assemblies given the disclosure contained herein.

The present disclosure is illustratively described above in reference to the disclosed embodiments. Various modifications and changes may be made to the disclosed embodiments by persons skilled in the art without departing from the scope of the present disclosure as defined in the appended claims.

The invention claimed is:

1. A lighting fixture, comprising:

a light engine;

a front ring module;
and
a first structure comprising:
means for biasing the front ring module toward the light engine;
a first bracket coupled to the light engine; and
a second bracket having a first end coupled to the front ring module and a second end slidably positioned in a slot defined in the first bracket,
wherein the biasing means is coupled to the front ring module, and
wherein the biasing means is coupled to the first bracket.

2. The lighting fixture of claim 1, wherein the biasing means comprise:
at least one of a spring or an elastic band.

3. A lighting fixture, comprising:
a light engine;
a front ring module; and
a first structure comprising:
means for biasing the front ring module toward the light engine,
a first bracket coupled to the light engine; and
a second bracket having a first end coupled to the front ring module and a second end coupled to the biasing means,
wherein the biasing means is coupled to the first bracket,
wherein the light engine comprises a heatsink having a plurality of heat fins,
wherein a guide slot is defined between two adjacent heat fins, and
wherein the second bracket is slidably positioned in the defined guide slot.

4. A lighting fixture, comprising:
a light engine;
a front ring module; and
a first structure comprising:
a first bracket coupled to the light engine, means for biasing the front ring module toward the light engine;
a second bracket having a first end coupled to the front ring module and a second end slidably positioned in a slot defined in the first bracket,
wherein the biasing means is coupled to the first bracket, and
wherein the biasing means is coupled to the second bracket to urge the front ring module toward the light engine.

5. The lighting fixture of claim 4, wherein:
a longitudinal slot is defined in the second bracket; and
a guidepost is provided through the second bracket slot and coupled to the light engine.

6. The lighting fixture of claim 5, wherein the light engine comprises a heat sink and wherein the guidepost is coupled to the heat sink.

7. The lighting fixture of claim 1, further comprising:
a cylinder coupled to the front ring module.

8. A light engine, comprising:
a heat sink comprising a plurality of heat fins;
a guide slot defined between two adjacent heat fins;
a front ring module;
a first bracket coupled to the heat sink; and
at least one biasing member coupled between the heat sink and the front ring module, wherein the at least one biasing member comprises at least one of a spring or an elastic band, wherein a first end of the spring or elastic band is coupled to the first bracket;
a second bracket haying a first end coupled to the front ring module and a second end coupled to a second end of the spring or elastic band;
wherein the at least one biasing member is configured to urge the front ring module toward the heat sink, and
wherein the second bracket is slidably positioned in the defined guide slot.

9. A light engine, comprising:
a heat sink;
a front ring module;
a first bracket coupled to the heat sink;
at least one biasing member coupled to the first bracket and coupled between the heat sink and the front ring module; and
a second bracket having a first end coupled to the front ring module and a second end slidably positioned in a slot defined in the first bracket,
wherein the at least one biasing member is coupled to the second bracket to urge the front ring module toward the heat sink.

10. The light engine of claim 9, wherein:
a longitudinal slot is defined in the second bracket; and
a guidepost is provided through the second bracket slot and coupled to the heat sink.

11. A light engine, comprising:
a heat sink;
a first bracket coupled to the heat sink;
a front ring module;
at least one biasing member coupled between the heat sink and the front ring module;
a second bracket having a first end coupled to the front ring module and a second end slidably positioned in a slot defined in the first bracket,
wherein the at least one biasing member is configured to urge the front ring module toward the heat sink,
wherein the at least biasing member is coupled to the first bracket, and
wherein the at least one biasing member is coupled to the front ring module.

12. A light engine, comprising:
a heat sink comprising:
a plurality of heat fins; and
a guide slot defined between two adjacent heat fins;
a first bracket coupled to the heat sink;
a front ring module;
at least one biasing member coupled between the heat sink and the front ring module; and
a second bracket having a first end coupled to the front ring module and a second end coupled to the at least one biasing member,
wherein the at least one biasing member is coupled to the first bracket,
wherein the at least one biasing member is configured to urge the front ring module toward the heat sink, and
wherein the second bracket is slidably positioned in the defined guide slot.

* * * * *